US008720112B2

(12) United States Patent
Eungard

(10) Patent No.: US 8,720,112 B2
(45) Date of Patent: May 13, 2014

(54) DOOR LEVELING APPARATUSES AND ASSOCIATED METHODS OF MANUFACTURE AND USE

(75) Inventor: William C. Eungard, Waterford, WI (US)

(73) Assignee: 4Front Engineered Solutions, Inc., Carrollton, TX (US)

( * ) Notice: Subject to any disclaimer, the term of this patent is extended or adjusted under 35 U.S.C. 154(b) by 15 days.

(21) Appl. No.: 13/079,437

(22) Filed: Apr. 4, 2011

(65) Prior Publication Data

US 2012/0247021 A1 Oct. 4, 2012

(51) Int. Cl.
*E05F 11/00* (2006.01)
*E05F 15/00* (2006.01)

(52) U.S. Cl.
USPC ..... 49/200; 49/197

(58) Field of Classification Search
USPC ..... 49/197, 199, 200; 160/191, 192, 193; 52/126.1, 126.3, 223.13, 291, 573.1; 74/502.4, 502.6; 403/306, 307
See application file for complete search history.

(56) References Cited

U.S. PATENT DOCUMENTS

| | | | | |
|---|---|---|---|---|
| 1,453,426 | A * | 5/1923 | Williams | 114/101 |
| 2,477,265 | A * | 7/1949 | Peck | 24/115 R |
| 2,504,635 | A | 4/1950 | Bradley | |
| 3,075,234 | A | 1/1963 | Speakman | |
| 3,201,814 | A | 8/1965 | Le Clear | |
| 3,854,258 | A * | 12/1974 | Colado et al. | 52/223.13 |
| 4,047,258 | A | 9/1977 | Burnham | |
| 4,286,410 | A | 9/1981 | Hahn | |
| 4,293,969 | A | 10/1981 | Frommelt | |
| 4,422,199 | A | 12/1983 | Frommelt | |
| 4,557,008 | A | 12/1985 | Jurden | |
| 4,630,989 | A | 12/1986 | Davey | |
| 4,682,382 | A | 7/1987 | Bennett | |
| 4,711,059 | A | 12/1987 | Layne | |
| 4,744,121 | A | 5/1988 | Swessel et al. | |
| 4,945,606 | A | 8/1990 | Eckel | |

(Continued)

FOREIGN PATENT DOCUMENTS

| | | |
|---|---|---|
| AU | 2006230657 | 5/2007 |
| WO | WO-9410073 | 5/1994 |

(Continued)

OTHER PUBLICATIONS

Frommelt VHLS Vertical Under-leveler Seal, Installation Instructions, Frommelt Products Corporation, Pub. No. VHLS-0003, May 2007, 16 pages.

(Continued)

*Primary Examiner* — Katherine Mitchell
*Assistant Examiner* — Shiref Mekhaeil
(74) *Attorney, Agent, or Firm* — Perkins Coie LLP

(57) ABSTRACT

Door leveling apparatuses are disclosed herein. A door leveling apparatus configured in accordance with one embodiment includes a bracket mounted to a door, such as a vertically-opening sectional door. The apparatus further includes a cable assembly having a first end portion coupled to the bracket and a second end portion coupled to a door lifting system, such as a counterbalance assembly. The first end portion includes an adjuster that enables an operator to adjust the operational length of the cable assembly extending between the lifting system and the bracket, thereby enabling the operator to individually adjust the lengths of two such cable assemblies on opposite sides of the door to align the door with a corresponding opening.

19 Claims, 9 Drawing Sheets

(56) References Cited

U.S. PATENT DOCUMENTS

| | | | | |
|---|---|---|---|---|
| 4,987,708 | A * | 1/1991 | Wilcox | 52/126.6 |
| 5,001,799 | A | 3/1991 | Alexander et al. | |
| 5,088,143 | A | 2/1992 | Alexander | |
| 5,168,681 | A * | 12/1992 | Ayrapetyan | 52/223.7 |
| 5,313,681 | A | 5/1994 | Alexander | |
| 5,396,676 | A | 3/1995 | Alexander et al. | |
| 5,442,825 | A | 8/1995 | Hahn et al. | |
| 5,475,888 | A | 12/1995 | Massey | |
| 5,535,561 | A * | 7/1996 | Schuyler | 52/223.13 |
| 5,584,212 | A * | 12/1996 | Wild | 74/502.6 |
| 5,832,554 | A | 11/1998 | Alexander | |
| 6,073,402 | A | 6/2000 | Moody | |
| 6,125,491 | A | 10/2000 | Alexander | |
| 6,163,913 | A | 12/2000 | DiSieno et al. | |
| 6,179,510 | B1 * | 1/2001 | Meicke et al. | 403/306 |
| 6,195,949 | B1 * | 3/2001 | Schuyler | 52/223.13 |
| 6,276,026 | B1 | 8/2001 | Wille | |
| 6,311,352 | B1 | 11/2001 | Springer | |
| 6,408,925 | B1 * | 6/2002 | Dorma | 160/191 |
| 6,442,783 | B1 | 9/2002 | Yoon et al. | |
| 6,487,741 | B2 | 12/2002 | Alexander | |
| 6,502,268 | B2 | 1/2003 | Ashelin et al. | |
| 6,588,482 | B2 * | 7/2003 | Wright | 160/193 |
| 6,654,976 | B2 | 12/2003 | Digmann et al. | |
| 6,769,149 | B2 | 8/2004 | Alexander | |
| 6,776,554 | B2 * | 8/2004 | Acciacca | 403/353 |
| 6,810,817 | B1 | 11/2004 | James | |
| 6,948,285 | B2 | 9/2005 | Miller et al. | |
| 6,983,785 | B2 * | 1/2006 | Altimore | 160/191 |
| 7,059,379 | B2 * | 6/2006 | Lewis et al. | 160/191 |
| 7,146,673 | B1 | 12/2006 | Digmann et al. | |
| 7,162,762 | B1 | 1/2007 | Gleason et al. | |
| 7,213,285 | B2 | 5/2007 | Mitchell | |
| 7,216,391 | B2 | 5/2007 | Muhl et al. | |
| 7,230,819 | B2 | 6/2007 | Muchow et al. | |
| 7,334,281 | B2 | 2/2008 | Digmann et al. | |
| 7,334,498 | B2 * | 2/2008 | Yokomori et al. | 74/502.4 |
| 7,363,670 | B2 | 4/2008 | Mitchell et al. | |
| 7,533,504 | B2 * | 5/2009 | Johnson | 52/223.13 |
| 7,537,042 | B2 * | 5/2009 | Altimore | 160/191 |
| 2002/0092102 | A1 | 7/2002 | Lounsbury | |
| 2003/0178158 | A1 | 9/2003 | Schulte | |
| 2004/0117927 | A1 | 6/2004 | Gleason | |
| 2005/0091766 | A1 | 5/2005 | Gleason | |
| 2005/0273949 | A1 | 12/2005 | Gleason | |
| 2006/0016147 | A1 | 1/2006 | Johnson | |
| 2006/0053694 | A1 * | 3/2006 | Hormann et al. | 49/197 |
| 2007/0101517 | A1 | 5/2007 | Digmann et al. | |
| 2007/0101518 | A1 | 5/2007 | Digmann et al. | |
| 2008/0052843 | A1 | 3/2008 | Eungard et al. | |
| 2009/0165224 | A1 | 7/2009 | Digmann et al. | |
| 2010/0031457 | A1 | 2/2010 | Gleason et al. | |
| 2010/0264596 | A1 | 10/2010 | Whitley et al. | |
| 2011/0047725 | A1 | 3/2011 | Story et al. | |
| 2011/0220304 | A1 * | 9/2011 | Diaz | 160/191 |
| 2011/0308744 | A1 * | 12/2011 | Kicher | 160/191 |

FOREIGN PATENT DOCUMENTS

| | | |
|---|---|---|
| WO | WO-2007056744 | 5/2007 |
| WO | WO-2007076507 | 7/2007 |
| WO | WO-2009085515 | 7/2009 |
| WO | WO-2011/025793 | 3/2011 |

OTHER PUBLICATIONS

Frommelt VHL Under-leveler Seal (Model VHLS), Architectural Specifications, 2 pages.

Frommelt VHLS Under-leveler Seal for Vertical Hydraulic Leveler, Rite-Hite Holding Corporation, 1 page [Internet accessed Aug. 28, 2007].

* cited by examiner

DOOR LEVELING APPARATUSES AND ASSOCIATED METHODS OF MANUFACTURE AND USE

TECHNICAL FIELD

The present disclosure relates generally to door leveling apparatuses and, more specifically, to door leveling apparatuses for use with loading dock doors and other doors that move vertically in opposing guide tracks to open and close.

BACKGROUND

Loading docks and other buildings that require relatively large doorways typically utilize sectional doors that retract upwardly to open. Sectional doors typically include a plurality of rectangular panels connected together by hinges along upper and lower edges. The door panels typically carry rollers or other guide members that extend outwardly from the side edges to engage guide channels in door tracks that extend vertically along each side of the door opening. Seals (e.g., bulb seals) are often provided along the side edges of the door panels to seal the gaps between the door and the door tracks. Some door tracks (e.g., tracks for "overhead" doors) extend horizontally into the building above the door so that the door is stored in this position when fully opened. Other door tracks extend vertically, or at least generally vertically, along the wall above the door opening so that the door is stored in a generally vertical position when fully opened.

Many vertically-opening doors are manually opened, while others include powered or automatic door opening systems. Moreover, many vertically-opening door systems include a counterbalance assembly positioned above the door to assist opening. Conventional counterbalance assemblies include two cable drums positioned on opposite ends of a shaft. Each drum carries a cable that is wound around the drum at one end and attached to an upper corner of the door at the other end. The shaft is typically coupled to a one or more torsion springs that bias the drums in a direction that puts tension on the cables to assist raising the door.

Vertically-opening doors should be properly aligned and positioned relative to the door opening. Otherwise, the gaps between the side edges of the door panels and the door tracks may be uneven or excessive. For doors having seals along the side edges, this misalignment can result in gaps between the guide tracks and the seals which may in turn lead to a number of undesirable consequences, including loss of heating or cooling energy, contamination, etc.

Conventional methods for leveling vertically-opening doors typically include enlisting the aid of a specialist to adjust the relative lengths of the two counterbalance assembly cables. This usually involves repositioning one or both of the cable drums on the shaft to take up or let out more cable as necessary to adjust the door angle. This approach has a number of shortcomings, not the least of which is the need to engage a specialist, which can be time-consuming and costly. Moreover, it may be difficult to fine tune cable length by rotating the corresponding cable drum. Accordingly, it would be advantageous to provide a system and method that would enable a door operator to easily and quickly adjust the orientation and/or position of a vertically-opening door without the need for special tools or training.

DETAILED DESCRIPTION

The present disclosure describes various embodiments of door leveling apparatuses for use with loading dock doors and other doors that move vertically to open with the assistance of a counterbalance assembly or similar system. In one embodiment, for example, a door leveling apparatus configured in accordance with the present disclosure can include a pair of brackets mounted to opposite corners of a door panel. Each of the brackets can be coupled to one end of a corresponding cable assembly. The opposite end of each cable assembly is wound around a corresponding drum on a horizontal shaft of a counterbalance assembly positioned above the door. The shaft can be coupled to one or more torsion springs that bias the drums in a direction that pulls on the cables to lift or at least assist lifting the door during opening. In one aspect of this embodiment, each cable is attached to its corresponding door bracket by a threaded end fitting which carries an adjuster, e.g., a threaded adjuster, such as a nut. Turning the adjuster in a first direction can effectively lengthen the corresponding cable, while turning the adjuster in the opposite direction can effectively shorten the cable. Accordingly, one or both of the cable adjusters can be turned as necessary to adjust the relative effective cable lengths and fine tune the vertical alignment of the door.

Certain details are set forth in the following description and in FIGS. 1-8 to provide a thorough understanding of various embodiments of the disclosure. Other details describing well-known structures and systems often associated with vertically-opening doors, counterbalance systems, etc. have not been set forth in the following disclosure to avoid unnecessarily obscuring the description of the various embodiments of the disclosure.

Many of the details, dimensions, angles and other features shown in the Figures are merely illustrative of particular embodiments of the disclosure. Accordingly, other embodiments can have other details, dimensions, angles and features without departing from the spirit or scope of the present invention. In addition, those of ordinary skill in the art will appreciate that further embodiments of the invention can be practiced without several of the details described below.

In the Figures, identical reference numbers identify identical, or at least generally similar, elements. To facilitate the discussion of any particular element, the most significant digit or digits of any reference number refers to the Figure in which that element is first introduced. For example, element 110 is first introduced and discussed with reference to FIG. 1.

Figure 1:
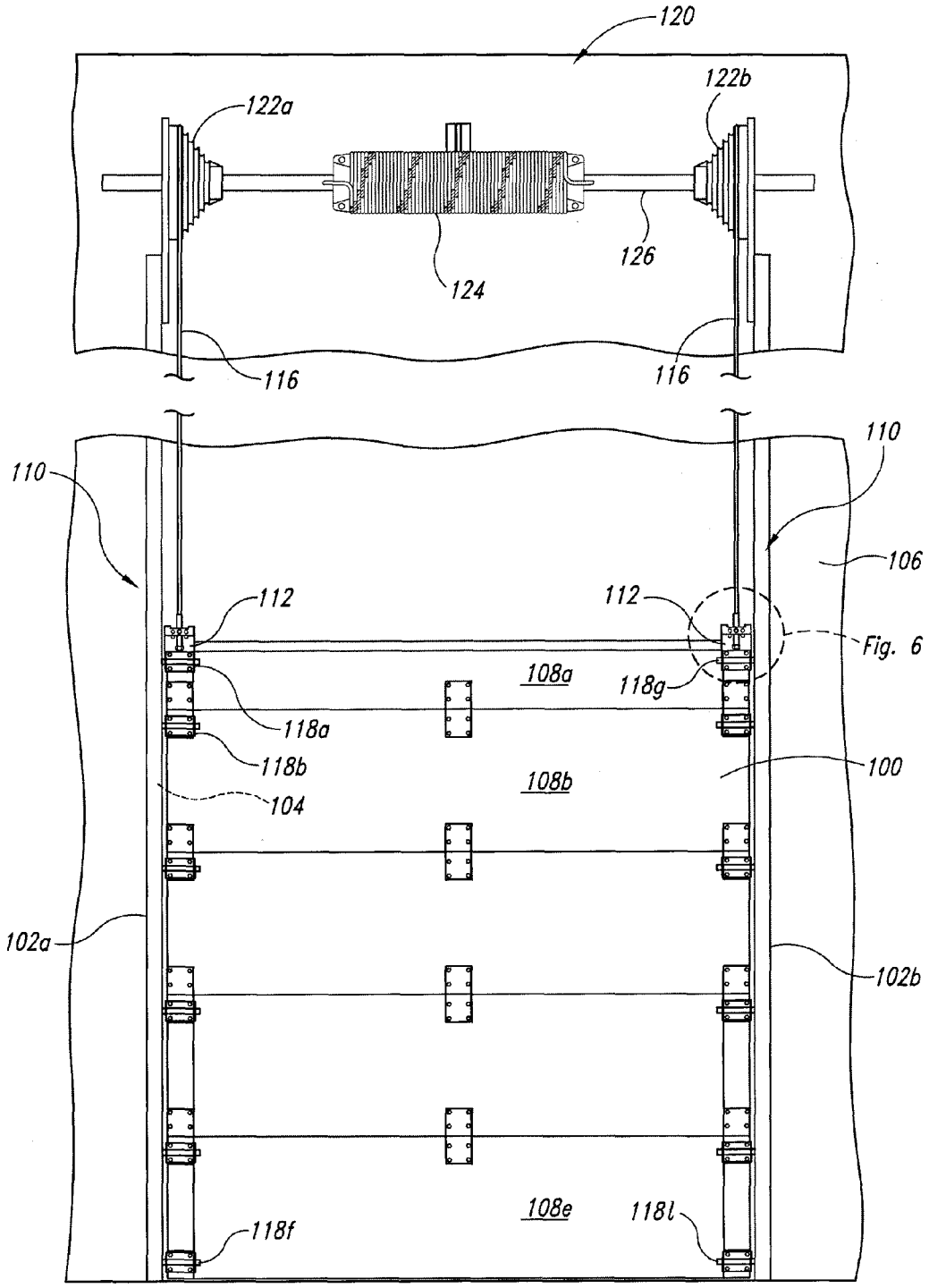
FIG. 1 is a view looking outwardly at a loading dock door having a door leveling apparatus configured in accordance with an embodiment of the present disclosure.

FIG. 1 is an interior view of a vertically-opening door 100 (e.g., a loading dock door) operably coupled to a lifting system 120 by two door leveling apparatuses 110 configured in accordance with an embodiment of the present disclosure. The door 100 covers an opening 104 in a building 106. In the illustrated embodiment, the door 100 includes a plurality of panels 108 (identified individually as door panels 108*a-e*) pivotally connected together with hinges in a conventional manner. Each side edge of the door panels 108 can include one or more guide members 118 (identified individually as guide members 118*a-l*) extending outwardly therefrom. The guide members 118 can include rollers, plungers and/or other suitable devices for engaging a guide channel in an adjacent door track 102 (identified individually as a first door track 102*a* and a second door track 102*b*) attached to the wall of the building 106 along each side of the door opening 104.

In one aspect of this embodiment, each of the door leveling apparatuses 110 includes a cable assembly 116 having a first end portion operably coupled to a door bracket 112. The opposite end portion of each cable assembly 116 is attached to a corresponding drum 122 (identified individually as a first drum 122*a* and a second drum 122*b*) mounted to a shaft 126 of the lifting system 120. In one embodiment, the lifting system 120 can be a conventional counterbalance assembly having one or more biasing members 124 (e.g., torsion springs) operably coupled to the shaft 126 to rotationally bias the drums 122 in a direction that applies tension to the cable assemblies 116 to assist manual raising of the door 100. In other embodiments, the lifting system 120 can include other types of systems that apply a lifting force to the door 100 to assist manual opening, as well as other powered systems that automatically lift the door 100. In the illustrated embodiment, the door brackets 112 are attached to the upper corners of the first door panel 108*a*. As described in greater detail below, however, in other embodiments the brackets 112 can be mounted to the door 100 in other locations and in other orientations depending on various factors, including the type of door (e.g., overhead verses vertically-storing), space constraints, accessibility, etc.

Figure 2:
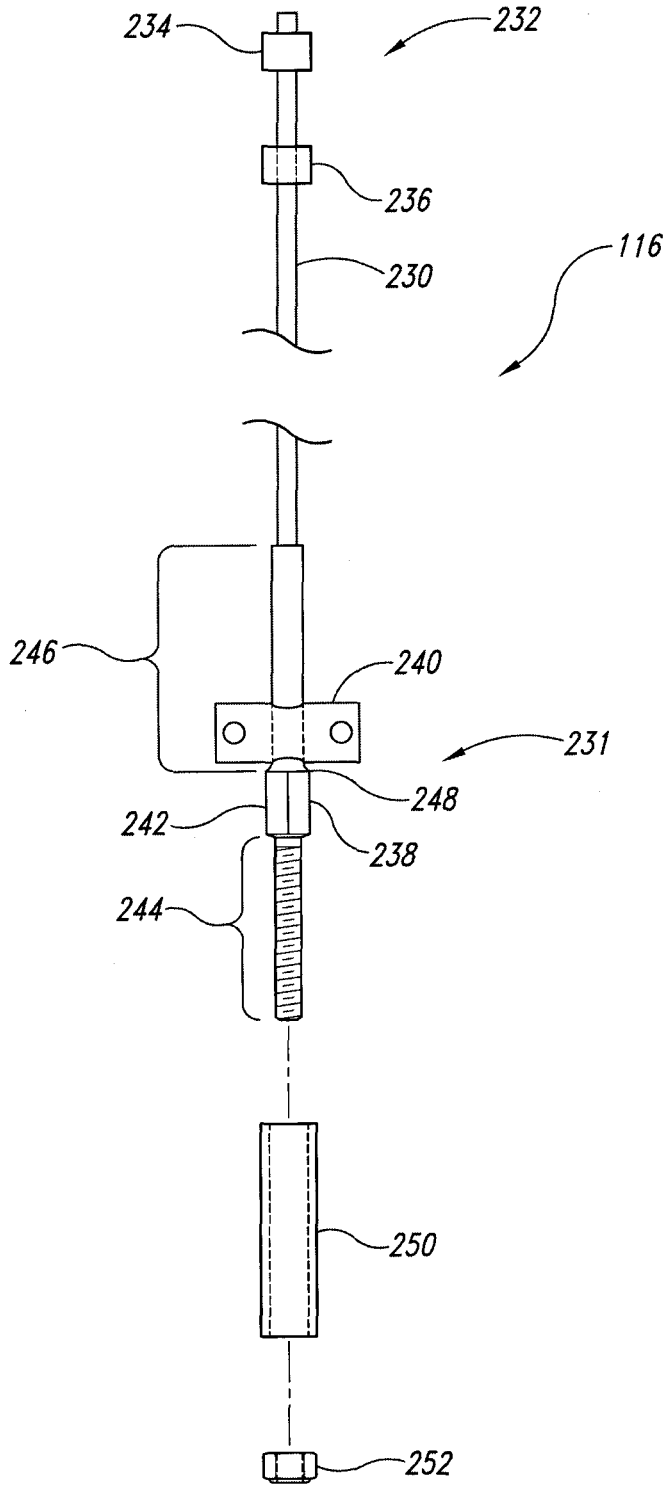
FIG. 2 is a partially exploded side view of a cable assembly from the door leveling apparatus of FIG. 1.

FIG. 2 is a partially exploded side view of the cable assembly 116 configured in accordance with an embodiment of the disclosure. The cable assembly 116 includes an elongate cable 230 extending between a first cable assembly end portion 231 and a second cable assembly end portion 232. In the illustrated embodiment, the cable 230 can be a steel cable of conventional construction, such as a 7×19 construction galvanized steel cable having a cross-sectional diameter of from about 0.12 inch to about 0.19 inch, or about 0.16 inch. In other embodiments, however, virtually any cable known in the art as having sufficient strength, wear, and other characteristics can be used.

An end fitting 238 has a collar portion 246 that is swaged onto the cable 230 toward the first end portion 231. In one aspect of this embodiment, the end fitting 238 also includes a cable stop portion 242 positioned between the collar portion 246 and an engagement or threaded portion 244. The cable stop portion 242 has a shoulder 248 that is larger in diameter, or is otherwise wider than the collar portion 246. The cable stop portion 242 can also include a plurality of wrench flats to facilitate gripping the end fitting 238 with a wrench or other suitable tool. The threaded portion 244 can include conventional external threads (e.g., ¼-20 UNC threads) for engaging complimentary internal threads on an adjuster 252 (e.g., a hexagonal nut, locknut, wingnut, or other internally threaded member). In one embodiment, the end fitting 238 can be a stainless steel, threaded stud end fitting, part number 259-5CTRH, as provided by Loos & Co., Inc., Cableware Division, of Naples, Fla. 34104. In other embodiments, however, other suitable end fittings having features similar to those described above can be used.

In another aspect of this embodiment, the cable assembly 116 further includes a cylindrical pin or lug member 240 that is slidably disposed over the collar portion 246 of the end fitting 238. As described in greater detail below, the collar portion 246 extends through an aperture in the lug member 240 that is smaller than the cable stop portion 242. As a result, the lug member 240 is able to slide back and forth on the collar portion 246 and the cable 230, but the lug member 240 cannot slide past the cable stop 242 and off the end fitting 238. An annular cable stop 234 can also be crimped, swaged or otherwise fixed to the opposite end of the cable 230 toward the second cable assembly end portion 232 to facilitate attachment of the cable assembly 116 to the cable drum 122. In addition, the cable assembly 116 can also include an optional floating cable stop 236 which is free to slide back and forth on the cable 230.

In addition to the foregoing components and features, the cable assembly 116 further includes a spacer 250 that slides over the threaded portion 244 and the cable stop portion 242 to abut the lug member 240, and is held in place by the adjuster 252. In the illustrated embodiment, the spacer 250 is a cylindrical member having a central through-hole with an inner diameter that is slightly greater than the cable stop portion 242 to enable the spacer 250 to slide over the cable stop portion 242. The spacer 250, cable stop 234, and floating cable stop 236 can be manufactured from suitable materials known in the art. Such materials can include, for example, stainless steel, galvanized steels, steel alloys, etc.

Figure 3A:
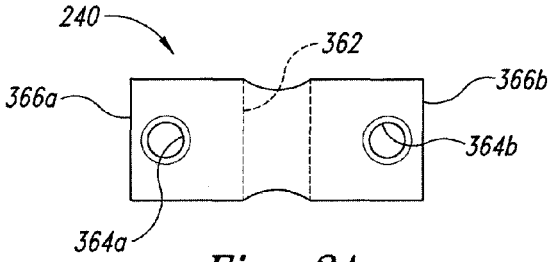
FIGS. 3A-3C are enlarged side, end, and top views, respectively, of a lug member from the cable assembly of FIG. 2.
Figure 3B:
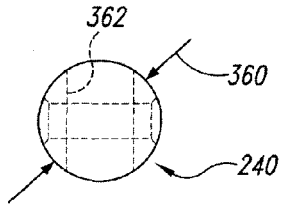
Figure 3C:
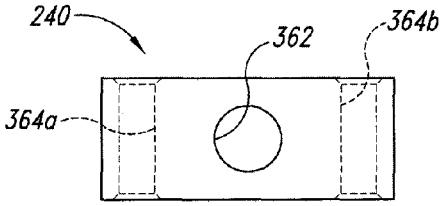

FIGS. 3A-3C are side, end, and top views, respectively, of the lug member 240. Referring to FIGS. 3A-3C together, in the illustrated embodiment, the lug member 240 is a generally cylindrical pin or member having an outside diameter 360 of from about 0.25 inch to about 0.75 inch, or about 0.5 inch. In other embodiments, the lug member 240 can have other cross-sectional shapes and/or other dimensions depending on the particular application. For example, in other embodiments the lug member and/or portions thereof can have a spherical shape, a rectangular shape, and/or a wide variety of other suitable shapes. A through-hole 362 extends transversely through a mid-portion of the lug member 240, and is sized to slidably receive the collar portion 246 of the end fitting 238 (FIG. 2). As discussed above with reference to FIG. 2, however, the inner diameter of the through-hole 362 is smaller than the outer diameter of the shoulder 248 on the cable stop portion 242 to prevent the lug member 240 from sliding off of the end fitting 238 during use. By way of example, in one embodiment the collar portion 246 can have an outer diameter of about 0.25 inch, the through-hole 362 can have an inner diameter of about 0.27 inch, and the shoulder 248 can have an outer diameter of about 0.30 inch or more. In other embodiments, however, these components and features can have other dimensions as long as the functional relationship between the components remains the same.

The lug member 240 can further include two additional through-holes 364 *a, b* extending transversely through opposite lug member end portions 366*a, b* of the lug member 240. As described in greater detail below, the outer through-holes 364 are configured to receive a locking member, such as a cotter pin, to hold the lug member 240 in place on the door bracket 112. The lug member 240 can be formed from any number of suitable materials known in the art, including, for example, carbon steels such as AISI 1018 CF carbon steel.

Figure 4A:
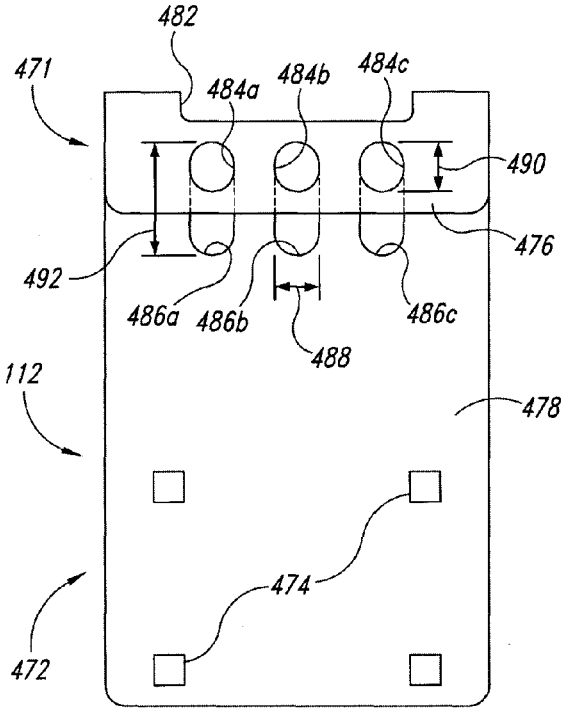
FIGS. 4A and 4B are enlarged front and side views, respectively, of a door bracket from the door leveling apparatus of FIG. 1.
Figure 4B:
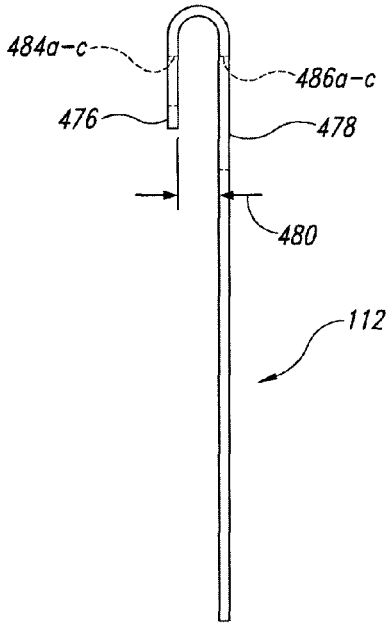

FIGS. 4A and 4B are front and side views, respectively, of the door bracket 112 configured in accordance with an embodiment of the disclosure. Referring to FIGS. 4A and 4B together, the door bracket 112 includes a clevis portion or first bracket end portion 471 formed into an inverted "U" shaped cross-section having a return flange or front panel portion 476 spaced apart from a mounting or rear panel portion 478 by a gap 480. The first bracket end portion 471 includes a cutout 482. The gap 480 can be at least approximately equal to the outer diameter 360 of the lug member 240 described above with reference to FIGS. 3A-3C. For example, if the outer diameter 360 is about 0.5 inch, then the gap 480 can be about 0.5 inch.

The front panel portion 476 includes a plurality of first apertures 484 (identified individually as first apertures 484*a-c*) configured to receive one end portion of the lug member 240, and the rear panel portion 478 includes a plurality of corresponding second apertures 486 (identified individually as second apertures 486*a-c*) configured to receive the opposite end portion of the lug member 240. Although the door bracket 112 of the illustrated embodiment includes three pairs of lug member apertures from which an operator can choose, in other embodiments, the door bracket 112 and variations thereof can include more or fewer sets of apertures for receiving the lug member 240.

In the illustrated embodiment, the first apertures 484 and the second apertures 486 have generally oval shapes configured to accommodate installation and retention of the lug member 240. For example, if the outer diameter 360 of the lug member 240 is about 0.5 inch, then the first aperture 484 can have a width 488 of from about 0.505 inch to about 0.53 inch, or about 0.51 inch, and a length 490 of from about 0.57 inch to about 0.62 inch, or about 0.59 inch. The second apertures 486 can have the same width 488 as the first apertures 484, but can have a longer length 492 of from about 1 inch to about 1.5 inch, or about 1.3 inch. As described in greater detail below, elongating the first and second apertures 484, 486 in the foregoing manner can facilitate coupling of the lug member 240 to the bracket 112 during assembly of the door leveling apparatus 110 (FIG. 1). In addition to the foregoing features, the door bracket 112 can also include a plurality of fastener apertures 474 located toward a second bracket end portion 472 for receiving bolts and/or other suitable fasteners for attaching the door bracket 112 to the door panel 108*a* (FIG. 1). In the illustrated embodiment, the door bracket 112 can be formed from 11 gauge steel sheet. In other embodiments, however, the door bracket 112 can be formed or otherwise manufactured from various other suitable materials known in the art having sufficient strength, corrosion and other characteristics.

Figure 5A:
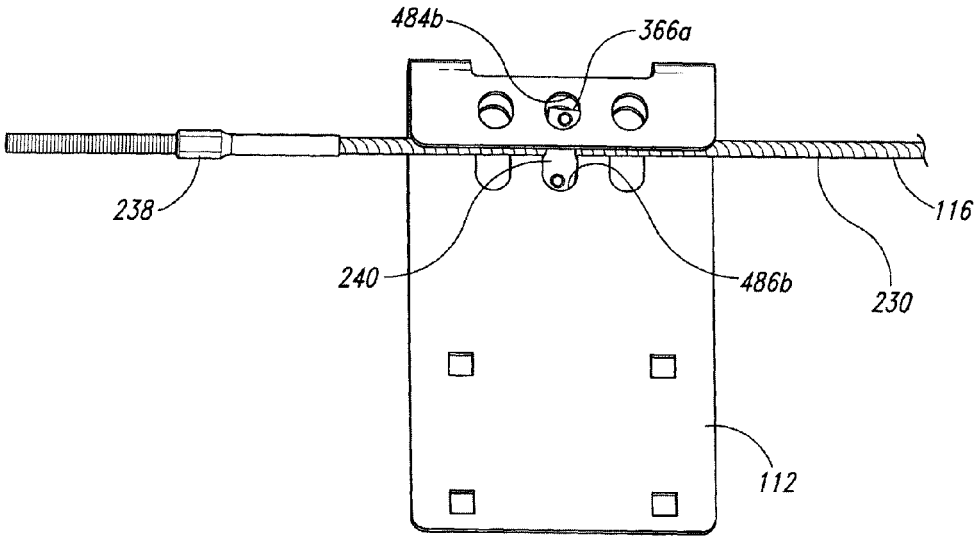
FIGS. 5A-5E are a series of front views illustrating various stages of a method of coupling the cable assembly of FIG. 2 to the door bracket of FIGS. 4A and 4B in accordance with an embodiment of the present disclosure.
Figure 5B:
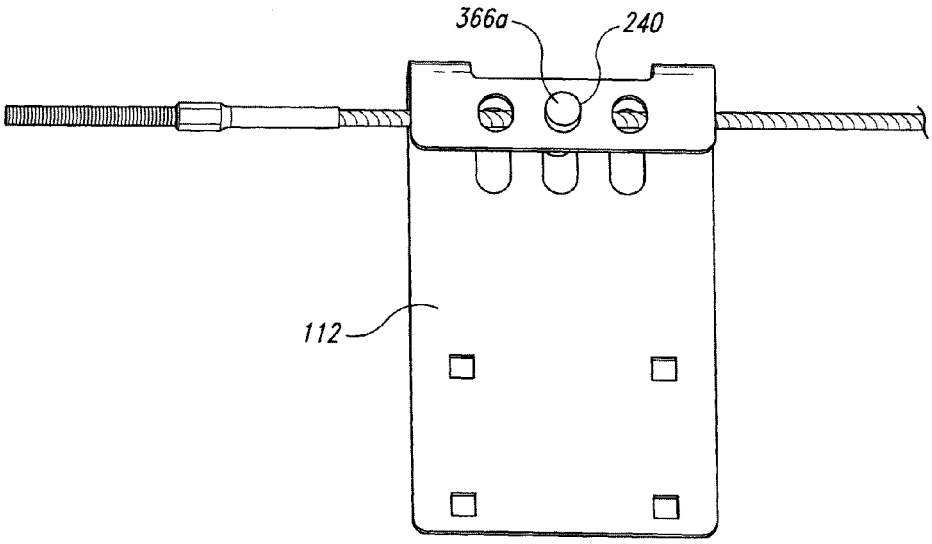

FIGS. 5A-5E are a series of views illustrating various stages of a method for coupling the cable assembly 116 to the door bracket 112 in accordance with an embodiment of the disclosure. As those with an ordinary skill in the art will appreciate, although the following discussion describes one possible method for installing the cable assembly 116, other methods including variations on the steps disclosed can also be used without departing from the present disclosure. Referring first to FIG. 5A, with the lug member 240 installed on the cable 230 as described above with reference to FIG. 2, the lug member 240 is positioned between the front panel portion 476 and the rear panel portion 478 of the door bracket 112 adjacent to a pair of selected apertures 484 and 486 (e.g., 484*b* and 486*b*). The particular apertures 484,486 used can be selected based on the relative position of the corresponding cable drum 122 (FIG. 1), the desired cable angle, and/or other factors. The second lug member end portion 366*b* (FIG. 3A) of the lug member 240 is disposed in the second aperture 486*b*, while the first lug member end portion 366*a* is positioned adjacent to the corresponding first aperture 484*b*. As shown in FIG. 58, the operator then rotates the lug member 240 upwardly about the cable 230 until the first lug member end portion 366*a* protrudes through the first aperture 484b and the second lug member end portion 366*b* protrudes through the second aperture 486*b*.

Figure 5C:
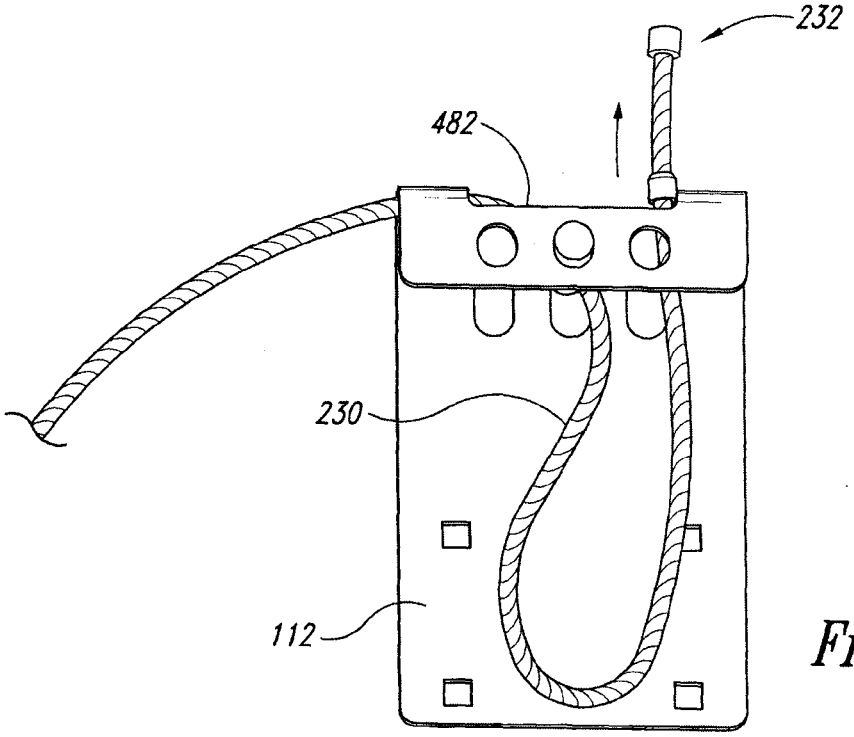
Figure 5D:
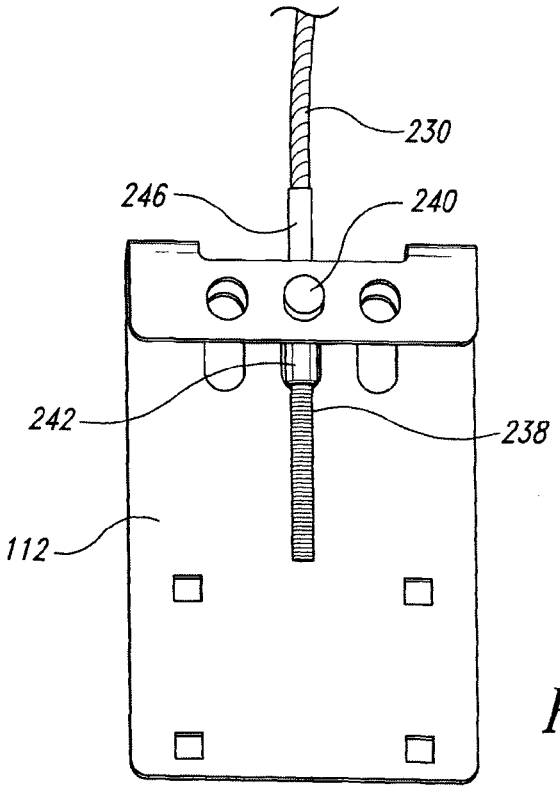

Referring next to FIG. 5C, with the lug member 240 now fully engaged in the apertures 484, 486, the cable 230 and the lug member 240 are rotated so that the operator can extend the second cable assembly end portion 232 through the cut-out 482 in the door bracket 112. The operator pulls the second cable assembly end portion 232 away from the bracket 112 to draw the cable 230 and the collar portion 246 through the lug member 240 until the cable stop portion 242 of the end fitting 238 abuts the lug member 240 as shown in FIG. 5D. The second cable assembly end portion 232 of the cable assembly 116 can now be installed on the corresponding cable drum 122 (FIG. 1) in a conventional manner.

Figure 5E:
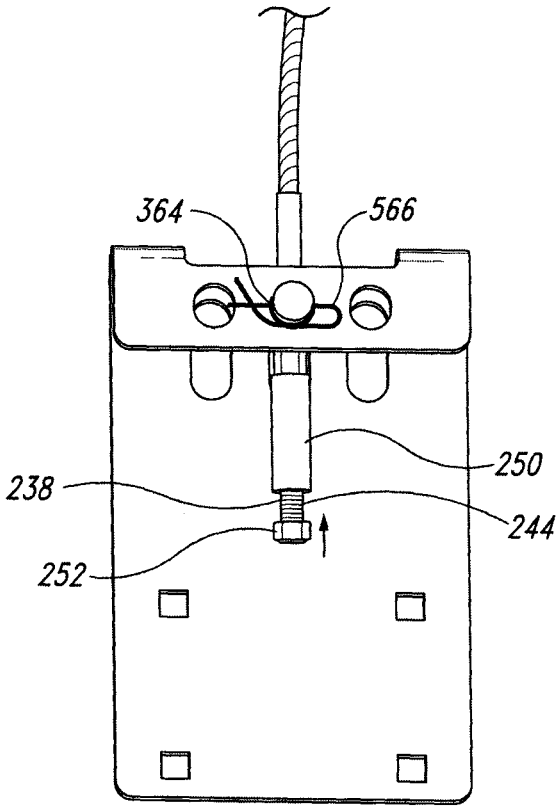

Referring next to FIG. 5E, the operator installs a lock member or keeper 566 (e.g., a cotter pin, Rue ring, etc.) through each of the apertures 364 in both ends of the lug pin 240 to capture the lug member 240 on the door bracket 112 and prevent it from inadvertently falling out of the apertures 484, 486. In addition, the operator can slide the spacer 250 over the threaded portion 244 and the cable stop portion 242 of the end fitting 238 until it abuts the lug member 240. The operator then threads the adjuster 252 onto the threaded portion 244 in a conventional manner to trap the spacer 250 in place on the end fitting 238.

Figure 6:
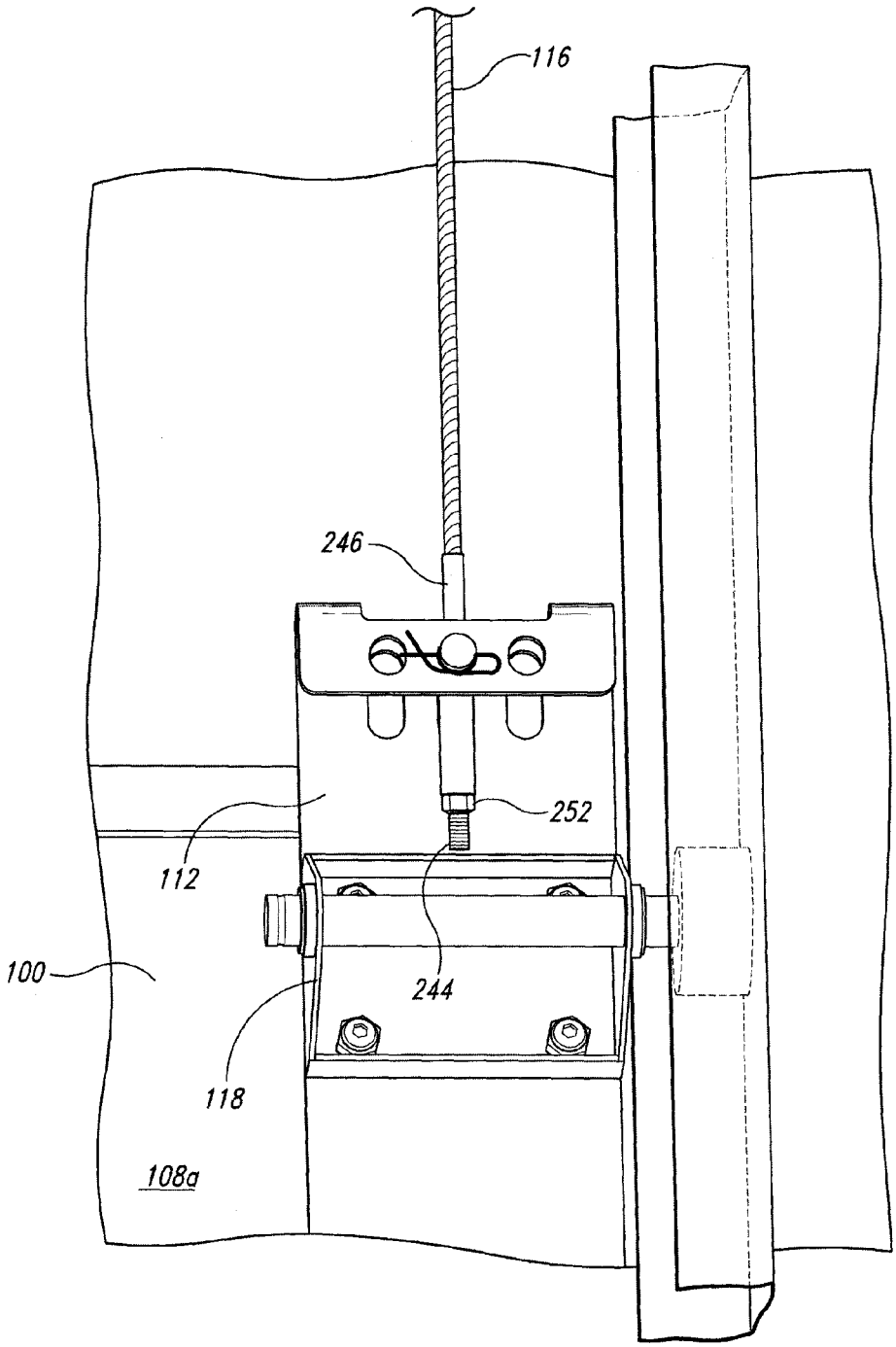
FIG. 6 is an enlarged view taken from FIG. 1 illustrating various aspects of the door leveling apparatus in more detail.

FIG. 6 is an enlarged view taken from FIG. 1 showing the attachment of the cable assembly 116 to the door bracket 112 in more detail. Referring to FIGS. 1 and 6 together, to adjust the effective length of the cable assembly 116 and thereby adjust the alignment of the door 100 relative to the tracks 102, the operator can grip the collar portion 246 of the end fitting 238 with a suitable tool (e.g., a pair of pliers) and turn the adjuster 252 with another tool (e.g., a wrench) in an appropriate direction to increase or decrease the effective length of the cable assembly 116 as desired. More specifically, turning the adjuster 252 in a first direction (e.g., clockwise) so that the adjuster 252 moves further onto the threaded portion 244 draws the cable 230 toward the lug member 240, thereby effectively shortening the cable assembly 116. Conversely, turning the adjuster 252 in the opposite direction (e.g., counter-clockwise) to move the adjuster 252 further aft on the threaded portion 244 effectively lengthens the cable assembly 116. In the event the operator inadvertently turns the adjuster 252 too close to the end of the threaded portion 244 and the adjuster 252 falls off, the end fitting 238 will only slide through the hole 362 in the lug member 240 (FIGS. 3A-3C) until the cable stop portion 242 (FIG. 2) abuts the lug member 240, thereby stopping further movement. This feature prevents the cable assembly 116 from coming loose and letting the door 100 drop.

Although the door brackets 112 described above with reference to FIGS. 1 and 6 are positioned at the top of the door 100 and the corresponding cable assemblies 116 extend vertically to the corresponding cable drum 122, in other embodiments other mounting positions and orientations of the brackets 112 and/or the cable assemblies 116 can be used depending on the particular application. For example, in other embodiments the door brackets 112 can be mounted on the middle or bottom portions of the door 100. Moreover, in still further embodiments the door brackets 112 can be mounted horizontally and the cable assemblies 116 can be horizontally routed to the brackets 112 from an overhead counterbalance assembly via a suitable guide member (e.g., an eye bolt, pulley, etc.). In some embodiments involving overhead doors, the brackets 112 can be mounted near the bottom edge of the door, and the cable assemblies can extend upwardly along the exterior surface of the door to accommodate the upward and horizontal motion of the door during opening. Accordingly, as those of ordinary skill in the art will appreciate, the door leveling apparatuses and associated methods and systems described herein are not limited to use with a particular type of vertically-opening door in a particular manner, but can be used with a wide variety of doors and door systems.

Figure 7A:
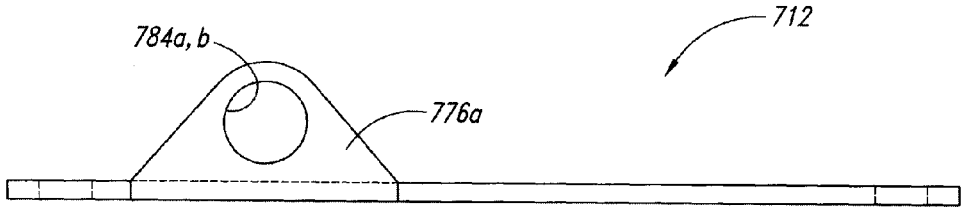
FIGS. 7A-7C are side, end, and top views, respectively, of a door bracket for use with a door leveling apparatus configured in accordance with another embodiment of the disclosure.
Figure 7B:
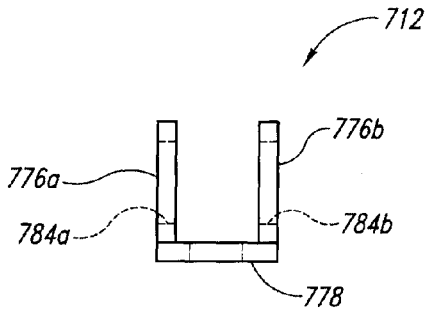
Figure 7C:
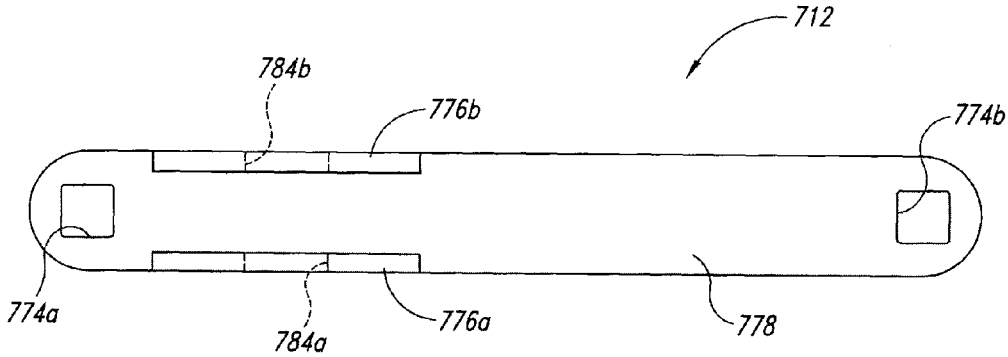

Various embodiments of the door leveling apparatuses described herein can provide advantages over conventional door leveling systems and methods. For example, the threaded end fitting 238 will not pull through the lug member 240 if the adjuster 252 inadvertently comes off of the end fitting during adjustment. Moreover, in some embodiments the first cable assembly end portion 231 of the cable assembly 116 can be easily attached to the bracket 112 with the second cable assembly end portion 232 of the cable assembly 116 already installed on the cable drum 122. This permits the cable assembly 116 to be easily replaced in the field. In addition, the cylindrical nature of the lug member 240 enables the cable 230 to rotate about both its longitudinal axis and the lug member axis, thereby reducing stress on the cable 230 and prolonging cable life. FIGS. 7A-7C are side, end, and top views, respectively, of a door bracket 712 for use with a leveling apparatus configured in accordance with another embodiment of the disclosure. Referring to FIGS. 7A-7C together, the door bracket 712 includes a generally flat and elongate mounting portion 778 having fastener apertures 774 (identified individually as a first fastener aperture 774*a* and a second fastener aperture 774*b*) in opposing end portions thereof for receiving fasteners to secure the bracket 712 to a door panel. For example, in one embodiment one bracket 712 can be mounted to each of the upper corners of the first door panel 108*a*, as shown in FIG. 1 for the door bracket 112. The door bracket 712 also includes two parallel and upstanding clevis flanges 776 (identified individually as a first flange 776*a* and a second flange 776*b*) extending outwardly from the mounting portion 778. The opposing flanges 776 each include a corresponding pin bore 784 which are axially aligned with each other. In the illustrated embodiment, the door bracket 712 can be manufactured from any suitable metal known in the art, such as 11-gauge galvanized steel. In other embodiments, the bracket 712 can be manufactured from other suitable materials that are bent, machined, welded, or otherwise formed to shape.

Figure 8:
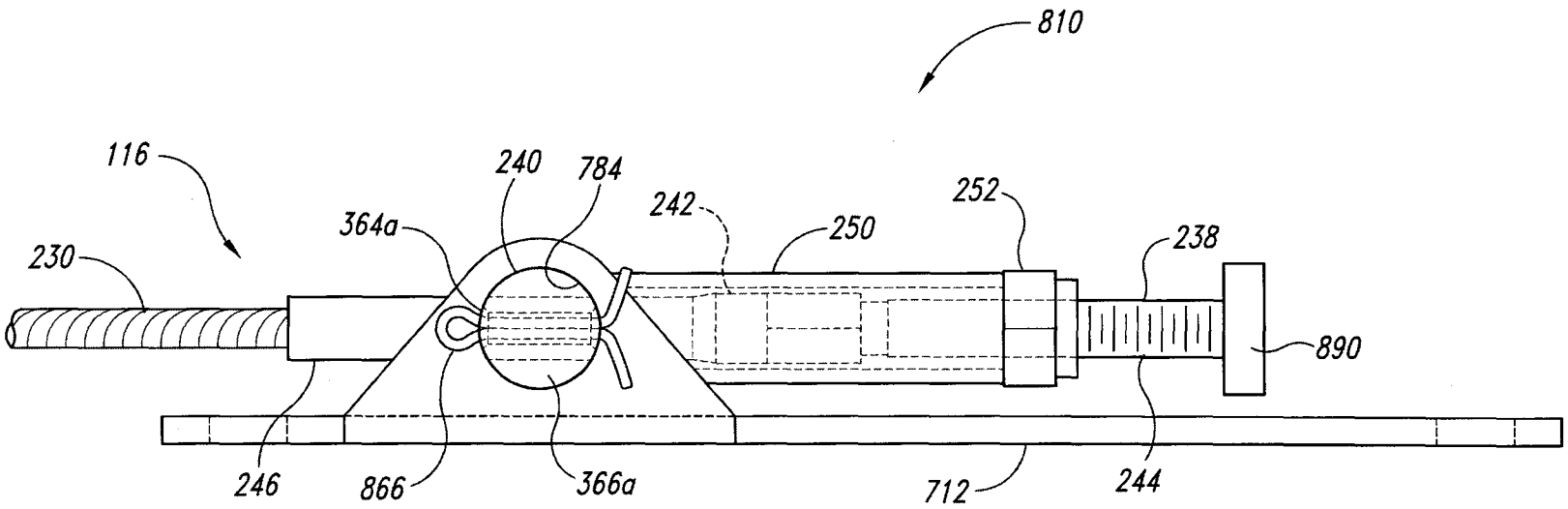
FIG. 8 is a side view of a door leveling apparatus that includes the bracket of FIGS. 7A-7C.

FIG. 8 is an enlarged side view of a door leveling apparatus 810 that includes the door bracket 712 described above with reference to FIGS. 7A-7C. In the illustrated embodiment, a lug member, such as the lug member 240, is operably received in the opposing pin bores 784 of the door bracket 712. More specifically, in this embodiment the opposing end portions 366 of the lug member 240 are rotatably received in the corresponding pin bores 784. A keeper, such as a cotter pin 866, Rue ring, etc. can be installed through each of the through-holes 364 in the end portions of the lug member 240 to retain the lug member 240 on the door bracket 712. In one aspect of this embodiment, however, the through-holes 364 in the lug member 240 can extend parallel to the central through-hole 362 (see, e.g., FIG. 3C) to facilitate installation of the keepers 866 in the lug member 240.

In the illustrated embodiment, the cable assembly 116 is operably coupled to the bracket 712 by means of the lug member 240 in substantially the same manner as described above with reference to FIGS. 5A-5E. More specifically, the cable 230 and collar portion 246 of the end fitting 238 are extended through the through-hole 362 in the mid-portion of the lug member 240 until the stop portion 242 on the end fitting 238 abuts the lug member 240. The adjuster 252 can then be installed on the threaded portion 244 of the end fitting 238 to retain the spacer 250 and adjust the effective length of the cable assembly 116 as necessary to level the corresponding door.

Various modifications can be made to both the door leveling apparatus 810 and the door leveling apparatus 110 described above with reference to FIGS. 1-6 without departing from the spirit or scope of the present disclosure. For example, in one embodiment the cable stop portion 242 on the end fitting 238 can be omitted such that the end fitting 238 would normally be able to pass entirely through the through-hole 362 (FIG. 3C) in the lug member 240. To prevent this from happening, however, a cable stop 890, such as a nut, collar, pin/through-hole combination, and/or other similar features can be welded or otherwise secured to the distal end portion of the end fitting 238 after the spacer 250 and the adjuster 252 have been installed. The cable stop 890 provides a fail-safe feature that prevents the cable assembly 116 from pulling all the way through the lug member 240 after installation. Accordingly, various modifications can be made to aspects of some of the embodiments disclosed herein without departing from the scope of the present disclosure.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

I claim:

1. A door leveling apparatus for use with a vertically-opening door having an associated lifting system, the door leveling apparatus comprising:

a bracket configured to be mounted to the door; and a cable assembly having a first cable assembly end portion configured to be coupled to the bracket and a second cable assembly end portion configured to be coupled to the lifting system, wherein the cable assembly includes:

an elongate cable extending between the first cable assembly end portion and the second cable assembly end portion;

an end fitting fixedly attached to the cable adjacent the first cable assembly end portion;

a lug member operably coupling the first cable assembly end portion to the bracket, wherein the lug member includes a through-hole that receives a portion of the end fitting, and wherein the end fitting includes a cable stop portion sized to abut the lug member and prevent the end fitting from passing completely through the through-hole;

a lock member engaging the lug member and preventing the lug member from being removed from at least one aperture in the bracket; and an adjuster configured to be operably engaged with the end fitting, wherein movement of the adjuster relative to the end fitting changes an operational length of the cable assembly extending between the lifting system and the bracket when the cable assembly is installed therebetween.

2. The door leveling apparatus of claim 1 wherein the cable assembly further comprises:

a spacer disposed on the end fitting between the adjuster and the lug member, wherein the cable stop portion is sized to pass through the spacer but not the through-hole in the lug member.

3. The door leveling apparatus of claim 1:

wherein the at least one aperture comprises a first aperture opposite a second aperture; and wherein the lug member has a first lug member end portion configured to be received in the first aperture, a second lug member end portion configured to be received in the second aperture, and the through-hole is positioned between the first and second lug member end portions.

4. The door leveling apparatus of claim 3 wherein the first aperture has a first length and the second aperture has a second length, greater than the first length.

5. The door leveling apparatus of claim 3 wherein the bracket includes a third aperture opposite a fourth aperture.

6. The door leveling apparatus of claim 1:

wherein the at least one aperture includes a first aperture and a second aperture;

wherein the bracket includes a front portion having the first aperture, a rear portion having the second aperture aligned with the first aperture, and a cutout positioned between the front and rear portions; and wherein the lug member has a first lug member end portion configured to be received in the first aperture, a second lug member end portion configured to be received in the second aperture, and the through-hole is positioned between the first and second lug member end portions, wherein the through-hole receives the portion of the end fitting that protrudes through the cutout in the bracket.

7. The door leveling apparatus of claim 1:

wherein the at least one aperture comprises a first aperture aligned with a second aperture;

wherein the lug member has a first lug member end portion configured to be received in the first aperture, a second lug member end portion configured to be received in the second aperture, and the through-hole is positioned between the first and second lug member end portions, wherein the through-hole receives the portion of the end fitting; and wherein the cable assembly further comprises a cylindrical spacer disposed on the end fitting and over the cable stop portion between the adjuster and the lug member.

8. The door leveling apparatus of claim 1 wherein the lifting system is a counterbalance having a cable drum mounted to a spring-biased shaft, and wherein the second cable assembly end portion is configured to be operably coupled to the cable drum.

9. The door leveling apparatus of claim 1 wherein the adjuster is configured to threadably engage the end fitting, wherein rotation of the adjuster in a first direction increases the operational length of the cable assembly, and wherein rotation of the adjuster in a second direction opposite to the first direction decreases the operational length of the cable assembly.

10. The door leveling apparatus of claim 1 wherein the adjuster is a threaded adjuster configured to engage a corresponding threading of the end fitting.

11. The door leveling apparatus of claim 1 wherein the lock member is a cotter pin or a Rue ring.

12. A door assembly comprising:

at least one door panel configured to extend across an opening in a building, wherein the door panel is movably engaged with vertical guide tracks positioned on opposite sides of the opening;

a bracket attached to the door panel;

a lifting system attached to a wall of the building proximate the opening;

an elongate cable having a first cable end portion and a second cable end portion, wherein the first cable end portion carries an end fitting operably coupled to the bracket and the second cable end portion is operably coupled to the lifting system;

an adjuster operably engaged with the end fitting, wherein movement of the adjuster relative to the end fitting changes the length of the cable extending between the bracket and the lifting system;

a lug member operably coupled to the bracket, wherein the lug member includes a through-hole that receives a portion of the end fitting, and wherein the end fitting includes a cable stop portion sized to abut the lug member and prevent the end fitting from passing completely through the through-hole when the adjuster is disengaged from the end fitting; and a lock member engaging the lug member and preventing the lug member from being removed from at least one aperture in the bracket.

13. The door assembly of claim 12 wherein the at least one aperture comprises a first aperture offset from a second aperture, and wherein the lug member comprises a cylindrical member having a first cylindrical member end portion received in the first aperture, a second cylindrical member end portion received in the second aperture, and the through-hole extends through the cylindrical member between the first and second cylindrical member end portions, and wherein the end fitting includes the cable stop portion sized to abut the cylindrical member and prevent the end fitting from passing completely through the through-hole when the adjuster is disengaged from the end fitting.

14. The door assembly of claim 12 wherein the lifting system includes a counterbalance assembly attached to the wall above the opening.

15. The door assembly of claim 12 wherein the lifting system includes a rotatable drum configured to apply tension to the cable during door opening, and wherein the second cable end portion is attached to the drum.

16. The door assembly of claim 12 wherein the cable is a first cable and the bracket is a first bracket mounted toward one side of the door panel, and wherein the door assembly further comprises a second bracket and a second cable, wherein the second bracket is mounted toward the other side of the door panel and the second cable has a third end portion coupled to the second bracket and a fourth end portion operably coupled to the lifting system.

17. A system for leveling a vertically-opening door, the system comprising:

a bracket configured to be mounted to the door;

a cable assembly having a first end portion configured to be operably coupled to the bracket and a second end portion configured to be operably coupled to a lifting system, wherein the cable assembly includes— means for adjusting the position of the first end portion relative to the bracket to change an operational length of the cable assembly extending between the bracket and the lifting system, wherein the means for adjusting is configured to operationally engage the first end portion of the cable assembly, and wherein the system further comprises means for preventing the first end portion of the cable assembly from separating from the bracket if the means for adjusting disengages from the first end portion of the cable assembly;

wherein the first end portion of the cable assembly includes an end fitting configured to extend through a lug member coupled to the bracket, and wherein the cable assembly further includes means for preventing the end fitting from passing all the way through the lug member; and a lock member engaging the lug member and preventing the lug member from being removed from at least one aperture in the bracket.

18. The system of claim 17 wherein the end fitting has a threaded portion, and wherein the means for adjusting includes means for threadably engaging the threaded portion of the end fitting.

19. The system of claim 17 wherein the means for adjusting includes threaded member that adjusts the position of the first end portion of the cable assembly by turning relative to the first end portion of the cable assembly.

* * * * *

UNITED STATES PATENT AND TRADEMARK OFFICE

CERTIFICATE OF CORRECTION

PATENT NO. : 8,720,112 B2
APPLICATION NO. : 13/079437
DATED : May 13, 2014
INVENTOR(S) : Eungard It is certified that error appears in the above-identified patent and that said Letters Patent is hereby corrected as shown below:

In the Claims

Column 11, line 18, claim 19, after "includes" insert -- a --.

Signed and Sealed this
Third Day of February, 2015

Michelle K. Lee

Michelle K. Lee
*Deputy Director of the United States Patent and Trademark Office*